US005177544A

United States Patent [19]

Kimura et al.

[11] Patent Number: 5,177,544

[45] Date of Patent: Jan. 5, 1993

[54] IMAGE FORMING APPARATUS CAPABLE OF DETECTING A RESIDUAL AMOUNT OF CUT PAPER

[75] Inventors: Shigeki Kimura, Fussa; Masafumi Tsuchiya, Higashiyamato; Kenji Kobayashi, Akigawa; Kenzo Ito, Kodaira; Kenji Igarashi, Takaidonishi, all of Japan

[73] Assignees: Casio Computer Co., Ltd.; Casio Electronics Manufacturing Co., Ltd., Tokyo, Japan

[21] Appl. No.: 772,882

[22] Filed: Oct. 8, 1991

[30] Foreign Application Priority Data

Nov. 14, 1990 [JP] Japan ..... 2-119260
Jun. 18, 1991 [JP] Japan ..... 3-146295

[51] Int. Cl.[5] ..... G03G 21/00

[52] U.S. Cl. ..... 355/308; 355/203; 355/209; 355/309; 355/316; 346/134; 400/624

[58] Field of Search ..... 355/40, 133, 203, 205, 355/206, 209, 316, 308, 309, 322, 321, 204; 271/145, 152; 221/6; 460/624, 613; 346/134

[56] References Cited

U.S. PATENT DOCUMENTS 4,922,294 5/1990 Nakagami et al. ..... 355/209

*Primary Examiner*—A. T. Grimley
*Assistant Examiner*—Matthew S. Smith
*Attorney, Agent, or Firm*—Nixon & Vanderhye

[57] ABSTRACT

An image forming apparatus includes a paper stacking section for stacking a plurality of paper sheets cut to a given size. In the image forming apparatus, a paper supplying section supplies the paper sheets one by one, an image forming section forms an image which corresponds to received image information on the paper sheet supplied from the paper supplying section, a discharging paper stacking section stacks a paper sheet discharged out of the apparatus after the image is formed on the paper sheet by the image forming section, and a marking section is provided separate from the image forming section and adapted to continuously apply an "absence of paper" warning mark to the paper sheet remaining in the paper stacking section during a given period of time from a time at which a residual amount of paper sheets on the paper stacking section is lowered below a given level during the supply of paper sheets by the paper supplying section to a given time preceding a time at which the residual amount of paper sheets is all used up to cause the image forming opeation to be stopped. By so doing, the user of the apparatus is informed of a reduced residual amount of paper sheets over the given period of time.

16 Claims, 13 Drawing Sheets

IMAGE FORMING APPARATUS CAPABLE OF DETECTING A RESIDUAL AMOUNT OF CUT PAPER

BACKGROUND OF THE INVENTION

1. Field of the Invention

The present invention relates to an image forming apparatus for continuously feeding cut paper.

2. Description of the Related Art

Generally, various image forming apparatuses, such as copiers, printers and facsimiles, employ paper as an image medium. The user of these apparatuses has to pay attention to a residual amount of paper and, if the paper is used up, replenish new paper promptly. On the other hand, a data output apparatus, such as a printer and a facsimile, unlike a copier and so on, is often not attended by an attendant. In order to initially prevent a possible inoperative state of the printer, facsimile, and so on, in particular, due to the absence of paper stored therein, it is necessary to, when a residual amount of paper is lowered below a predetermined level, inform the "absence of paper" state of the user and replenish paper.

In the existing printer and facsimile equipment using continuous paper, such as roll paper, a mark is coated as an "absence of paper" warning mark on the rear side of the continuous paper over a predetermined length range at the end portion of the continuous paper and new continuous paper is replenished in place of the "nearly used up" paper.

In recent times, a page printer using those cut paper sheets obtained by cutting plain continuous paper to a given length through the use of the electrophotography technique has extensively been accepted in view of its operability, its image keeping property and other excellent features. Further, the so-called plain paper facsimile equipment (FAX) using the electrophotography technique at the printer section emerges on the market. The page printer and plain paper FAX are also demanded for personal use as a compact unit to meet the personal OA equipments, such as computers and word processors.

In the page printer and plain paper FAX as set out above, many cut paper sheets are stored in a paper supply section and continuously fed to an image forming section by paper feeding means, such as paper supply rolls. In this case, it is not possible, unlike the continuous paper, to initially coat an "absence of paper" warning mark on the cut paper. This is because those cut paper sheets with such an "absence of paper" warning mark, if being so used, have to be so stored as to be fed at a subsequent phase of a paper feeding sequence and hence the advantages of using the cut paper sheets are impaired. Further, such a marked paper sheet as being also found in the continuous paper sheet is often unsightly for use as a formal document and undesirable for a storage purpose. For a relatively large page printer and plain paper FAX, use is made of a method for detecting a residual amount of paper sheets by, for example, a light sensor and blinking an "absence of paper" warning lamp in accordance with the detection signal. In this case, the user sometimes overlooks the blinked warning lamp. Instead of blinking the warning lamp, a warning mark display information may be sent to the image forming section, and then a warning mark is given on cut paper being sent. However, this method, like the above-described method, is undesirable for a storage purpose and makes the image forming control complex.

SUMMARY OF THE INVENTION

It is accordingly the object of the present invention to provide a compact, low-cost image forming apparatus which can detect a residual amount of cut papers by a simpler means, can properly inform an operator/user of a decreased residual amount of cut paper by applying an "absence of paper" warning mark to the paper and can prevent occurrence of the "absence of paper" state in advance.

According to the present invention, there is provided an image forming apparatus comprising:

a paper stacking section for stacking a plurality of paper sheets cut to a given size;

a paper supply section for supplying the paper sheets, one by one, which are stacked on the paper stacking section;

an image forming section for enabling an image which corresponds to supplied image information to be formed on the paper sheet supplied from the paper stacking section;

a discharging paper stacking section for stacking the paper sheet discharged out of the image forming apparatus after it has its image formed by the image forming section; and a marking section, provided separate from the image forming section, for continuously applying an "absence of paper" warning mark to the paper sheet remaining in the paper stacking means, during a given period of time from a time at which a residual amount of paper sheets on the paper stacking section is lowered below a given height level during the supply of the paper sheet by the paper supplying section to a given time preceding a time at which the residual amount of paper sheets is all used up to cause an image forming operation by the image forming section to be stopped and for, by so doing, informing a user of a reduced residual amount of paper sheets over the given period of time.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments of the present invention will be explained below with reference to FIGS. 1 to 14.

Figure 1:
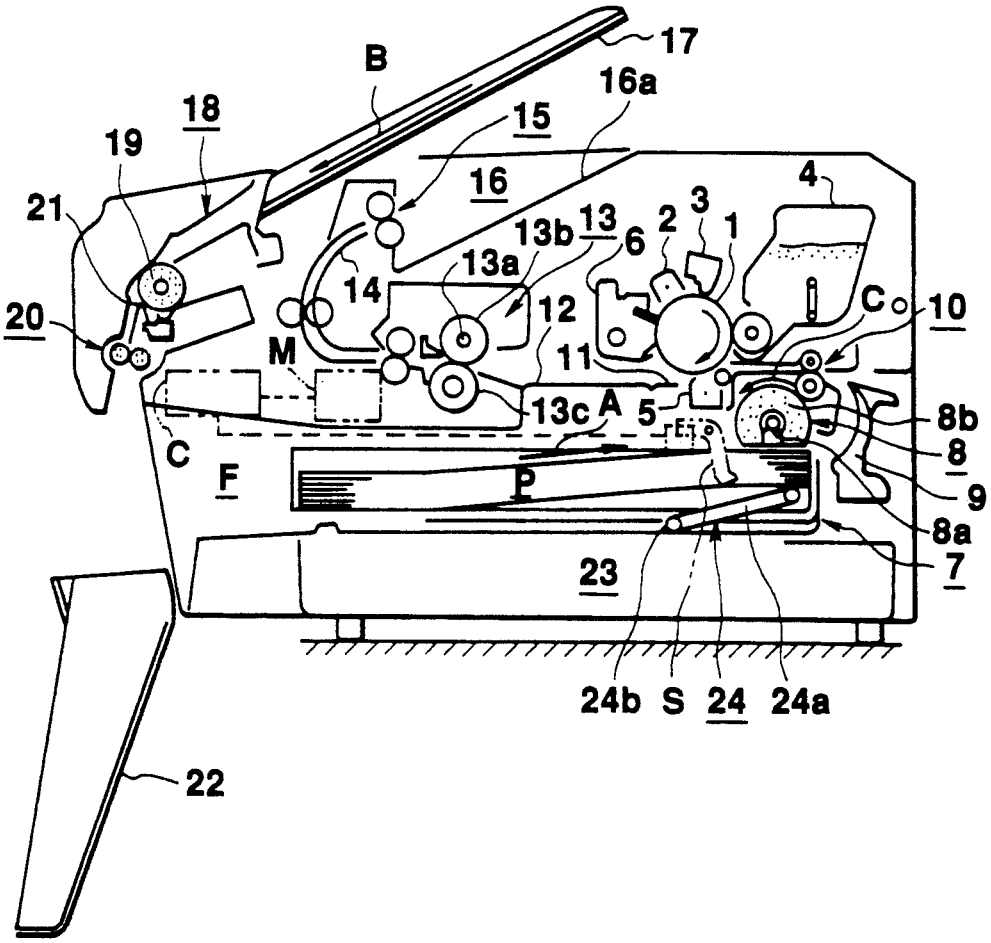
FIG. 1 is a diagrammatic model generally showing a plain paper FAX including a few embodiments of the present invention.

FIG. 1 is a cross-sectional view in side elevation diagrammatically showing a general arrangement of a plain paper FAX according to a first embodiment of the present invention where cut papers are employed. Substantially at the right center of the FAX body, a photosensitive drum 1 is provided such that it rotates in an arrow direction. A charger 2 for uniformly charging the outer peripheral surface of the photosensitive drum 1 at a predetermined potential (an initial potential), a light writing head 3 for projecting signal light on the surface of the photosensitive drum 1 corresponding to information received through a communication line and forming an electrostatic latent image on the surface of the drum, a developer 4 for imparting a toner to the electrostatic latent image to provide a visual toner image on the surface of the drum, a transfer charger 5 for electrostatically transferring the toner image to a paper sheet sent from the right side shown in FIG. 1, a cleaner 6 eliminating the toner remaining on the drum 1, and so on, are provided around, and along the rotation direction of, the drum 1.

A paper supply cassette 7 is provided at the lower portion of the machine body to store a stack of paper sheets P cut to a predetermined size. The cassette 7 is loaded and unloaded in a direction perpendicular to the paper sheet feeding direction A, that is, in a vertical direction as seen from the drawing sheet of FIG. 1.

The arrangement of a paper supply section F including the paper supply cassette 7 will be explained below in more detail.

A pair of paper sheet rolls 8 (only one is shown) are provided, as paper supply means, one on each side of the paper sheet cassette 7, to send paper sheets one by one, the paper sheet rolls 8 being located over the forward end portion of the cassette 7 as viewed in the direction of an arrow A in FIG. 1 and having a partcircular configuration. The paper sheet rolls are fixed on their common shaft 8*a*, and rotated in a direction of an arrow C in FIG. 1 with the rotation shaft 8*a* as a center during which time the surface of a rubber-covered surface of the circular section 8*b* of the respective paper sheet roll 8 are brought into interrupted engagement with the surface of the forward end portion of the topmost paper sheet on the paper stack to feed the topmost paper sheet in a paper sheet feeding direction A.

A turn guide 9 is provided at the forward side of the paper sheet roll 8 to guide the paper sheet upward while reversing the top side of the paper sheet. On a paper feed path from the end of turn guide 9 to the transfer charger 5, a pair of standby rolls 10 are provided for conveying the paper sheet to a transfer section in synchronism with the forward end of an image on the photosensitive drum 1.

On the left side of the transfer charger 5 as viewed from the drawing sheet of FIG. 1, a conveying guide 12 is provided such that it extends substantially parallel with a separation guide plate 11, guiding the paper sheet which is subjected to a transfer step and separated by a separation claw (not shown) to a fixing unit 13 on the downstream side. The fixing unit 13 includes a heating roll 13*b* and a pressure roll 13*c* having a tungsten halogen lamp 13*a* incorporated therein and enables an unfixed toner image-bearing paper sheet to be fed past the rolls 13*b* and 13*c*. By so doing, the toner image on the paper sheet is thermally fixed to the paper sheet.

A paper conveying path 14 is provided on the downstream (left) side of the fixing unit 13. The paper conveying path 14 extends first in a horizontal direction and then is turned upward and a pair of discharge rolls 15 are provided at the end of the paper conveying path 14. To the right side of the discharge rolls 15 as viewed in the drawing sheet of FIG. 1, a paper discharge tray section 16 is provided as a discharge paper stacking means. The discharge tray section of the present embodiment is provided by recessing the upper surface of the machine body obliquely. Paper sheets, which are discharged from the discharge rolls 15, are thus stacked on a surface 16*a* of the discharge tray section 16. In this case, the paper sheet is reversed on the paper discharge path 14 and discharged on the paper discharge tray section with the image transferred side down, that is, in the face-down manner.

Over the discharge tray section 16, a document glass 17 is provided such that it extends substantially parallel to the discharge tray surface 16*a*. A document conveying path 18 is provided along the forward end portion of the machine body from the document insertion side as viewed from a direction B in FIG. 1. A feed roll pair 19 and discharge roll pair 20 are arranged at the document conveying path 18 and an image scanner 21 is provided as an image reading means at a location between these roll pairs. A document tray 22 for receiving the discharge document is located below the discharge roll pair 2 such that it is suspended in a substantially vertical direction.

When document information is to be transmitted, the document is placed on the document glass 17 with its surface reversed so that the forward end of the document can be engaged with the feed rolls 19. When a transmission button on an operation panel (not shown) at the front of the machine body is depressed, the supply rolls 19 and discharge rolls 20 are rotated to allow the document to be conveyed and the reading of an image by the image scanner 21 to be started in a proper timing. By so doing, a light signal corresponding to the scanned image is converted to an electric signal which is in turn transmitted to a receiver side via the communication line. The discharge rolls 20 are also rotated, while the image is being read by the image scanner 21, and an already "read" document is discharged past the discharge rolls 20 into the document tray 22.

The arrangement of the paper supply section and paper supply cassette 7 in the present plain paper FAX will be explained below with reference to a plan view in FIG. 2 and cross-sectional view taken along line II—II in FIG. 2.

Figure 3:
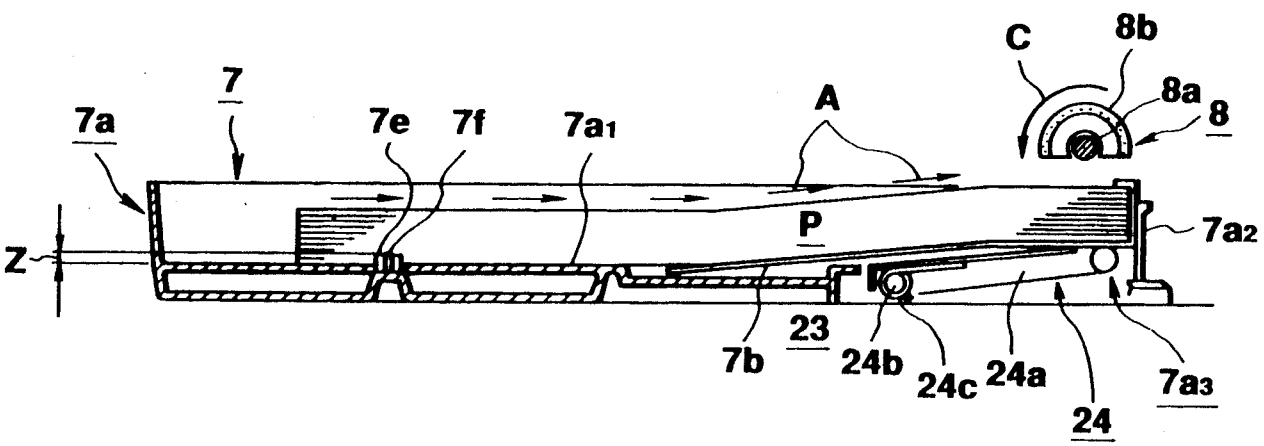
FIG. 3 is a cross-sectional view as taken along line II—II in FIG. 2.

FIG. 3 shows a bottom section $7a_1$ of a cassette case 7*a* formed of a top-cover-less box and, at the "forward end" side of the cassette case 7*a* as viewed in the paper feeding direction A, a paper stacking plate (paper stacking means) 7*b* is mounted so that it can be swung. The paper stacking plate 7*b* has its rear end pivotally supported at the middle of the cassette bottom section $7a_1$ so that the free end portion of the paper stacking plate 7*b* is swung up and down. The forward edge portions of the paper sheets P are stacked on the paper stacking plate 7*b*. An opening $7a_3$ is cut away at a location of the case's bottom section $7a_1$ in a direction some distance back from the forward wall $7a_2$ of the cassette case 7*a*. The opening $7a_3$ is provided to enable a push-up member 24 of the paper stacking plate 7*b* in the base 23 of the machine's paper supply section F (FIG. 1) to be accessed to the interior of the cassette case 7*a*. The push-up member 24 has a shaft 24*b* fixed to one end of the push-up lever 24*a* and is rotatably supported with the shaft 24*b* rotatably provided on the base of the paper supply section. A counterclockwise rotational force is imparted to the shaft 24*b* by an urging member, such as a coil spring 24*c*, in a direction in which an upward swing is effected. A manually operable lever, not shown, is connected to the shaft 24. Upon the operation of the manually operable lever, the shaft 24*b* and hence the push-up lever 24*a* are swung. Upon the loading and unloading of the paper supply cassette 7, the manually operable lever is operated, causing the push-up lever 24*a* to be clockwise swung down to a low position and to be so done against the rotational urging force of the urging member. When this is done, the push-up lever 24*a* is held to a low position by a latching mechanism, not shown.

Figure 2:
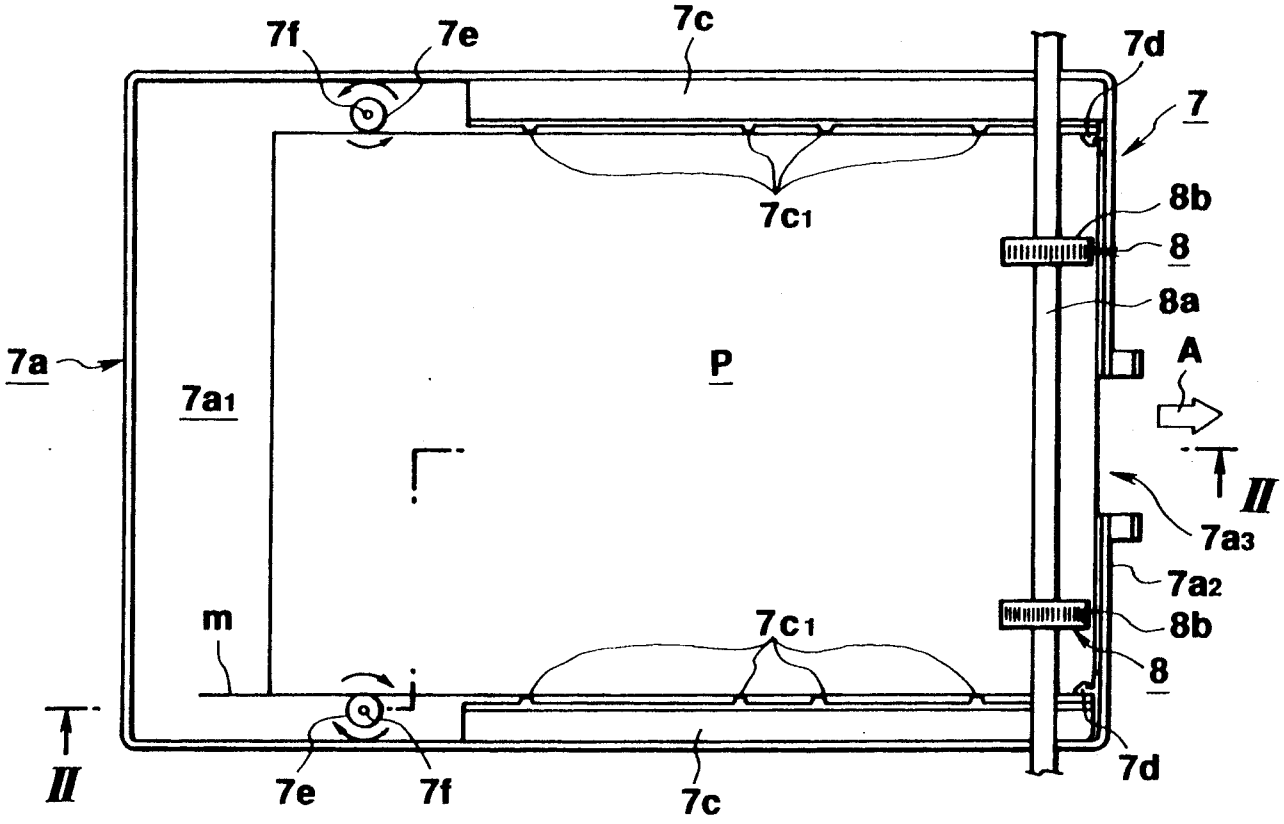
FIG. 2 is a plan view showing a paper supply cassette for a plain paper FAX according to one embodiment of the present invention.

In FIG. 2, side restriction plates 7*c*, 7*c* are mounted on both the sides of the cases' bottom section $7a_1$ to restrict the side position of the paper sheet. A plurality of projections $7c_1$ are provided at proper intervals on the inner surfaces of the respective side restriction plates 7*c*. The respective forward ends of the projections $7c_1$ contact with the sides of the stacked paper sheets, restricting the side positions of the paper sheets to arrange the paper sheets in a properly stacked position. At the corner areas where the side restriction plate 7*c* intersects the case's forward end portion $7a_2$, separation claws 7*d*, 7*d* are so provided that they can be swung up and down. The separation claws 7*d*, 7*d* engage with the corner portions of the forward end portions of a plurality of upper paper sheets to separate a topmost paper sheet from another adjacent paper sheet to allow it to be supplied.

Sponge rolls 7*e*, 7*e* for coating "absence of paper" warning marks on the end portion of the paper sheet are provided as a marking means on the rear side of the respective side restriction plates 7*c* as viewed from the paper feeding direction A. The ink roll 7*e* is rotatably fitted on a shaft 7*f* mounted upright at the bottom section $7a_1$ of the cassette case. The position of the respective ink roll 7*e* as viewed from the width direction of the cassette is so set as to have its outer peripheral surface somewhat more inwardly located than a straight line m passing on the ends of the projections $7c_1$. The ink roll 7*e* is impregnated with specific ink whose color disappears with the passage of time. If the ink roll 7*e* is wetted with, for example, orange color ink, the outer peripheral surface of the ink roll contacts with the side portions of the stacked paper sheet P. With the paper sheet supplied in the feeding direction A, the ink rolls are rotated, clearly coating the orange color ink on the side portion of the paper sheet. In this case, as shown in FIG. 3, only those paper sheets stacked over a height range Z from the bottom section $7a_1$ of the cassette case to the outer peripheral surface of the ink roll have their side portions coated with the orange color ink. That is, only a plurality of (for example, 30) paper sheets as counted from the bottommost paper sheet on the paper stack can be continuously coated with the orange color ink until the "absence of paper" state is reached. In practice, if the operator on the plain paper FAX visually recognizes the orange color ink on the side portion of the paper sheet during the period of time in which the stacked sheets are sequentially reduced in a receive print mode of the FAX, he or she notices that the "absence of paper" state soon occurs. This prompts the operator to replenish a new stack of paper sheets. The height level of the ink roll 7*e* determines the number of paper sheets on which the orange color ink is coated. In the case where the coating of the ink is hastened so as to secure an adequate amount of paper in the cassette at all times, it is only necessary to properly set the ink roll 7*e* to a proper height level. In addition to the aforementioned ink roll, other forms of marking means may be used as will be set out below.

Various forms of the present invention will be explained below in more detail.

Figure 4:
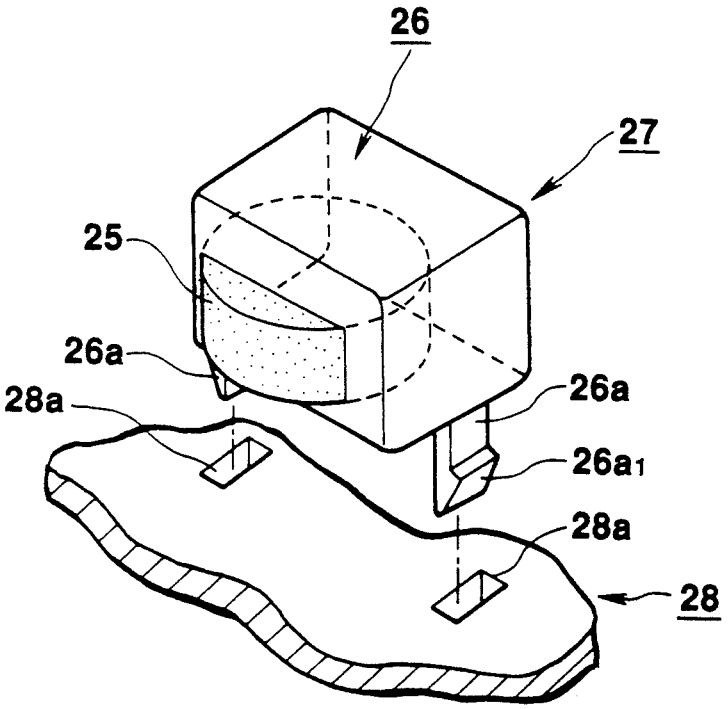
FIG. 4 is a perspective view showing another embodiment of the present invention.

The modified form of FIG. 4 constitutes an ink coater comprising an ink roll 25, similar to the ink roll 7*e* of the first embodiment, and an ink case 26 encasing the ink roll as shown in FIG. 4. Stated in more detail, ink is held in the ink case 26 and the ink roll 25 is rotatably encased with its outer periphery partly exposed. A pair of leg members 26*a*, 26*a* are provided on both the ends of the lower surface of the ink case 26 and have a hook, each, at its forward end. A pair of mount holes 28*a* and 28*a* extend through the bottom section 28 of the cassette case and correspond in position to the leg members 26*a* and 26*a*. The mount holes 28*a* and 28*a* are so located that the outer peripheral surface of the rolls 25 can be placed in contact with the side portions of some of paper sheets in a paper stack under a proper pressure force.

In the mounting of the aforementioned ink coater 27, the respective leg members 26*a* and 26*a* have only to be forced, from above, into the associated mount holes 28*a* and 28*a*. That is, the leg members 26*a* are flexibly inserted into the holes 28*a* under their own elastic force and spread apart on the rear side of the cassette case with the hooks $26a_1$ of the leg members 26*a* latched to the marginal edge portion of the mount holes 28*a*. Thus the ink coater 27 is readily fixed to the cassette case by the single insertion of the leg members of the ink coater 27. The ink coater 27 of the present invention ensures an adequate supply of ink over a longer period of time without being exhausted, enabling the ink to be coated as a clear mark on the paper sheet in a stable way.

An ink ribbon may be used in place of the ink coater. In this case, an endless type ink ribbon is stretched with one end held in an ink case so that a constant supply of ink is imparted to the ink ribbon. Further, in a so-called universal type cassette capable of holding any one of a plurality of sizes of paper sheets, corresponding mount holes may be provided in a manner to correspond to the side portion of paper sheets of respective size on a paper stack. In this case, it is only necessary to mount the ink coater in a proper position so as to meet the size (kind) of paper.

Figure 5A:
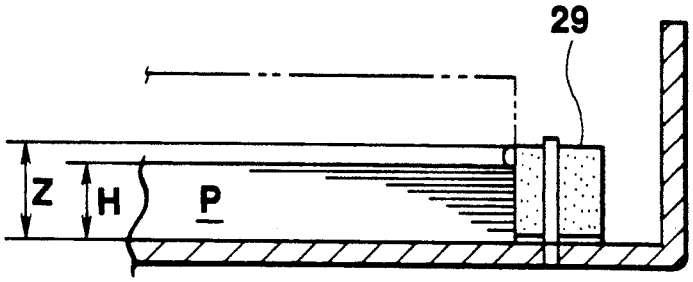
FIGS. 5A and 5B, each, show another embodiment of the present invention.
Figure 5B:
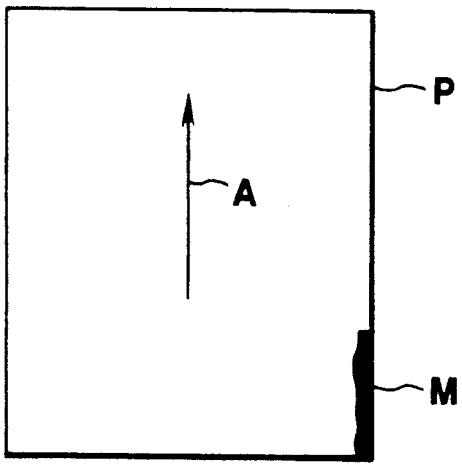

In the embodiment shown in FIG. 5A, an ink roll 29 of the same type as shown in FIG. 2 is made of a flexible material. When, in this case, a residual amount of paper sheets on a paper P stack is gradually reduced and a paper stack height H is reduced below a range of contact with the ink roll 29, the outer peripheral portion of the ink roll 29 which has ceased to contact with the paper tends to be returned back to the initial state under its own elasticity so that it extends on the upper surface of the paper. As a result, not only the side portion of the paper but also the upper side portion of the paper is coated with the ink, leaving a clear mark M on the paper, as shown in FIG. 5B, in the latter position. It is desirable, in this case, that the ink-coated surface of the paper be set in an upper surface side so that the residual amount of paper is visually recognized as reaching a "warning" range.

Further, it is also desirable that, if such a warning mark M is to be attached to a relatively large area on the paper, it be coated on the paper surface other than an image bearing surface of the paper.

In the preceding embodiment, the upper surface of the paper P emerges as the rear surface of the image forming area and, at the time of discharging the paper, the image bearing surface is set to a "face down" state in the paper conveying system of the present invention. Thus the coated "absence of paper" warning mark never spoils an image on the paper and the discharged paper is set with its reverse side up. It is possible to positively inform the operator that the "absence of paper" state is soon reached.

Figure 6:
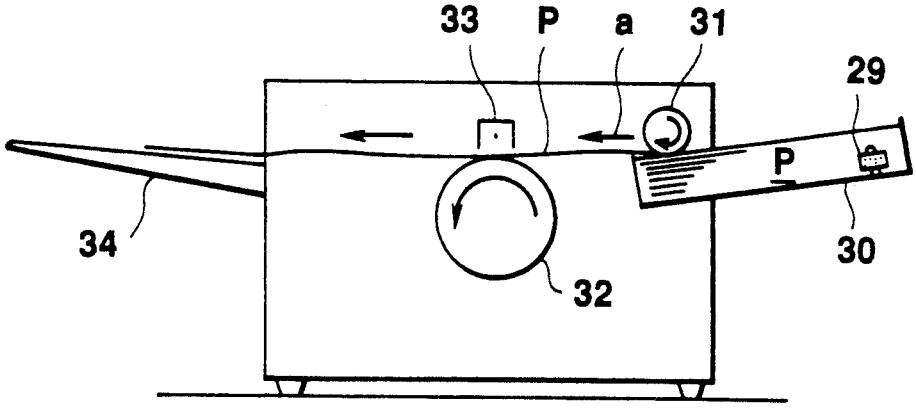
FIGS. 6 and 7, each, are a diagrammatic view showing a general example of a paper supply path.
Figure 7:
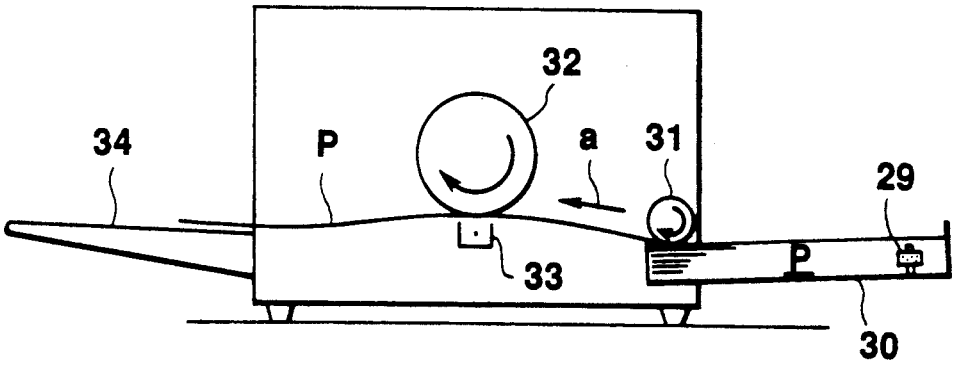

As the paper conveying system meeting the requirements as set out above, a straight type path, etc., may be listed by way of example, which employs a system capable of transferring an image to the under surface (back surface) of paper as shown in FIG. 6. In this case, a paper sheet on the paper P stack on a paper cassette 30 is fed by a paper supply roller 31, marked by an ink roll 29 with ink, image-transferred by a transfer unit from a photosensitive drum 32, image-fixed and discharged onto a discharge tray 34 with the image bearing surface down and the marked surface up. Needless to say, a straight type paper conducting path can also be used as shown in FIG. 7 in the case where a mark is coated on the image bearing surface of the paper.

In this case, specific ink color employed for the "absence of paper" mark disappears with the passage of time and, therefore, the soiling of the image bearing surface of the paper is a temporary phenomenon.

In the embodiment shown in FIG. 1, the marking means, such as an ink roll **7*e*, can be incorporated on the side restriction plate 7*c* such that it, together with the restriction plate 7*c*, can be moved as one unit. In the case where paper of different size is employed, it is only necessary to move the side restriction plate 7*c* in which case the ink roll 7*e*** is moved as one unit to a proper position. The operation of the paper supply cassette is improved. The marking means may be located in contact with not only the side portion but also the rear end portion of the paper sheet on the paper stack.

The ink for use for the "absence of paper" warning mark will be explained below in more detail.

In the present invention, the aforementioned ink is employed whose color disappears at the lapse of time. The ink consists of a coloring matter constituted by the three kinds of compounds, an electron-donative color developing organic compound ($\alpha$), a compound ($\beta$) having a volatile or sublinate phenolic hydroxyl group, and a nonvolatile compound ($\gamma$) for desensitizing an $\alpha/\beta$ color developing reaction. In this case, the compound ($\beta$) having a volatile phenolic hydroxyl group acts upon the colorless electron-donative color developing organic compound ($\alpha$) to produce a so-called electron donating/accepting reaction (color developing reaction) and hence coloration. The nonvolatile compound ($\gamma$) lowers a color developing function in the color developing reaction to control the degree of coloration. The disappearing of the developed color with the passage of time is accomplished due to the volatilization or sublimation of the phenolic hydroxyl group containing compound ($\beta$) following the coating of ink.

For the ink coating means, such as the ink rolls **7*e*, 25 and 29** as set out above, slow-drying color disappearing ink a given below is suitable from the standpoint of managing, for example, the replenishing of ink. As three components constituting the coloring matter use is made of:

a compound ($\alpha$): PSD-O (a fluoran series compound manufactured by Nisso Kako Co. Ltd.)

a compound ($\beta$): tertiarybutylcatechol a compound ($\gamma$): benzophenone

These compounds ($\alpha$), ($\beta$) and ($\gamma$) are blended at a 1:2:5 ratio, heated to 80° C. and melted to obtain a coloring matter a. The coloring matter a, while being maintained at 80° C., is dropwise added to an aqueous gelatin solution and agitated. Then the solution containing minute droplets of the coloring matter a is encapsulized using a coacervation method and the capsules are subjected to post-treatments, such as filtration, centrifugal concentration and drying to obtain microcapsules with the coloring matter a incorporated therein. 20 parts by weight of the microcapsules thus obtained, 70 parts by weight of a 5% methylcellulose aqueous solution and 10 parts by weight of a vinyl acetate emulsion are homogeneously mixed and agitated to obtain slow-drying ink a as set out above. The ink a assumes brilliant orange color.

The aforementioned slow-drying ink a is impregnated in the ink rolls (**7*e*, 25, 29). When the paper P stack is lowered to, for example, the range Z shown in FIG. 3, brilliant orange color "absence of paper" warning paper sheets are conveyed from the paper supply cassette 7 past the turn guide 9 to the transfer section at the transfer charger 5. At the transfer section, the sheet, being brought into contact with the peripheral surface of the photosensitive drum 1, has its "marked" portion never transferred to the outer peripheral surface of the drum 1** because the "absence of paper" warning mark is coated to that rear surface of the paper other than the image formation side of the paper.

The paper whose surface is image-transferred at the transfer section is conveyed to the fixing unit 13. At this time, the heating roll **13*b*** is heated to about 180° C. and a solvent (water) of the ink a of the "absence of paper" warning mark on the paper is evaporated and the slow-drying ink a is quickly dried up At the same time, the sublimation of the tertiarybutylcatechol as the compound ($\beta$) in the ink a is accelerated so that the disappearing of color is started. It is convenient at this time to have the microcapsules inforcedly collapsed between the fixing rolls.

As a result, a brilliant orange color "absence of paper" warning mark is coated on the side portion or rear surface of the paper as discharged on the discharge tray section. The operator/receiver of the plain paper FAX visually recognizes the orange color "absence of paper" mark coated at given places on the paper discharged onto the discharge tray surface. This prompts the operator/receiver to notice that the paper is in a short supply level in the paper sheet cassette 7. In the present plain paper FAX, a new supply of paper can positively be loaded before the remaining paper in the paper supply cassette 7 is used up. Late in the evening or early in the morning or during the vacation, including the holiday, at which no attendant is present near the FAX, it is possible, according to the present invention, to initially prevent a possible inadvertent occurrence of an "absence of paper" state and hence a "non-receivable" state whereupon the image forming performed by the image forming section is terminated. Since it is possible to estimate a possible residual amount of paper upon the view of the "marked" paper, there is no need to unload the paper supply cassette each time at such a time. Further, the "marked" ink color will disappear in about two weeks, offering a clean, spoil-less paper of excellent keeping quality. Further it is possible to use the slow-drying color disappearing ink favorable for the standpoint of controlling the furnishing of paper sheets and to do so by using excessive heat evolved at the fixing unit without any dedicated drying means. Thus the present plain paper FAX ensures enhanced maintainability and contributes the obtainment of a low cost, compact unit.

Although the present apparatus has been explained as stabilizing the color of the slow-drying color disappearing ink with the coloring matter micro-encapsulized, it is also possible to control the color disappearing time to a desired time period by differing in the blend ratio among the aforementioned three compounds for the coloring matter or by differing in the film structure in those microcapsules with the coloring matter incorporated therein. Although the methyl-cellulose has been used as a binder for the component of the aforementioned ink a, it is also possible to use polyvinyl alcohol in a 5% aqueous solution. In this case, the ink per se is of a slow-drying type and can be suitably used as ink impregnated in the ink roll of the present apparatus.

Although in the aforementioned first embodiment the ink rolls (7*e*, 25, 29) have been explained as contacting with the given level range of the stacked paper at all time, the second embodiment can be so formed that, once a paper stack is lowered below a predetermined amount, ink is supplied to a remaining amount of paper.

FIGS. 8 to 11 shows the second embodiment of the present invention. In this embodiment, a paper supply cassette case 7*a* is of such a type that one end of an interlock link mechanism L contacts with a push-up lever 24*a*. The interlock link mechanism L comprises first, second and third link bars 25, 26 and 27 in a series array. The push-up lever 24*a* is so connected that it is operated in interlock with a mark coating member 28 (marking means) located above the rear end portion of the paper supply cassette 7. The first link bar 25 contacting with the push-up lever 24*a* is rotatably supported by a fixed shaft 25*a* secured to a machine paper supply section F. The one end of the first link bar 25 which provides a projection 25*b* abuts against the lower surface of the push-up lever 24*a*. The other end of the first link bar 25 is rotatably connected by a movable shaft 29 to one end of the second link bar 26. A tension spring 30 is connected at one end to the machine body and at the other end to the other end portion of the first link bar 25. Below the other end portion of the first link bar 25, a stopper pin 31 is secured to the machine body 31 to prevent a counterclockwise rotation of the first link bar 25.

The second link bar 26 is rotatably supported on the fixed shaft 26*a* fixed to the machine body. The other end of the second link bar 26 is movably connected by the movable shaft 32 to one end of the third link bar. An elongated hole 27*a* is provided at the other end portion of the third link bar 27.

The mark coating member 28 is bifurcated, that is, substantially Y shaped, at one end portion with a base end portion of the bifurcation rotatably supported by a fixed shaft 28*a* which is fixed to the machine body. At an upper one of a pair of branch 28*b*, 28*c* of the mark coating member 28, an ink roll 28*d* is rotatably mounted which is made of flexible porous material, such as sponge. The ink roll 28 is impregnated with ink whose color disappears with the passage of time as set out above. The ink is replenished to the mark coating member 28, for example, by manually feeding it with the use of a dropping pipette, by using a cartridge type ink roll 28*d* per se so that exchange can be made or by connecting a flexible pipe to the shaft of the ink roll 28*d* to allow the ink to be continuously fed. The lower branch 28*c* of the mark coating member 28 contacts with the top surface of a paper P stack and serves as a support arm for preventing the ink roll 28*d* from contacting with the paper P. An engaging pin 28*e* is mounted at the other end portion of the mark coating member 28. The engaging pin 28*e* is loosely inserted in the elongated hole 27*a* of the third link bar 27 to couple the mark coating member 28 to the third link bar 27 in an engaging relation.

The interlock operation using an interlock link mechanism L of the push-up lever 24 and mark coating member 28 will be explained below in more detail.

Figure 8:
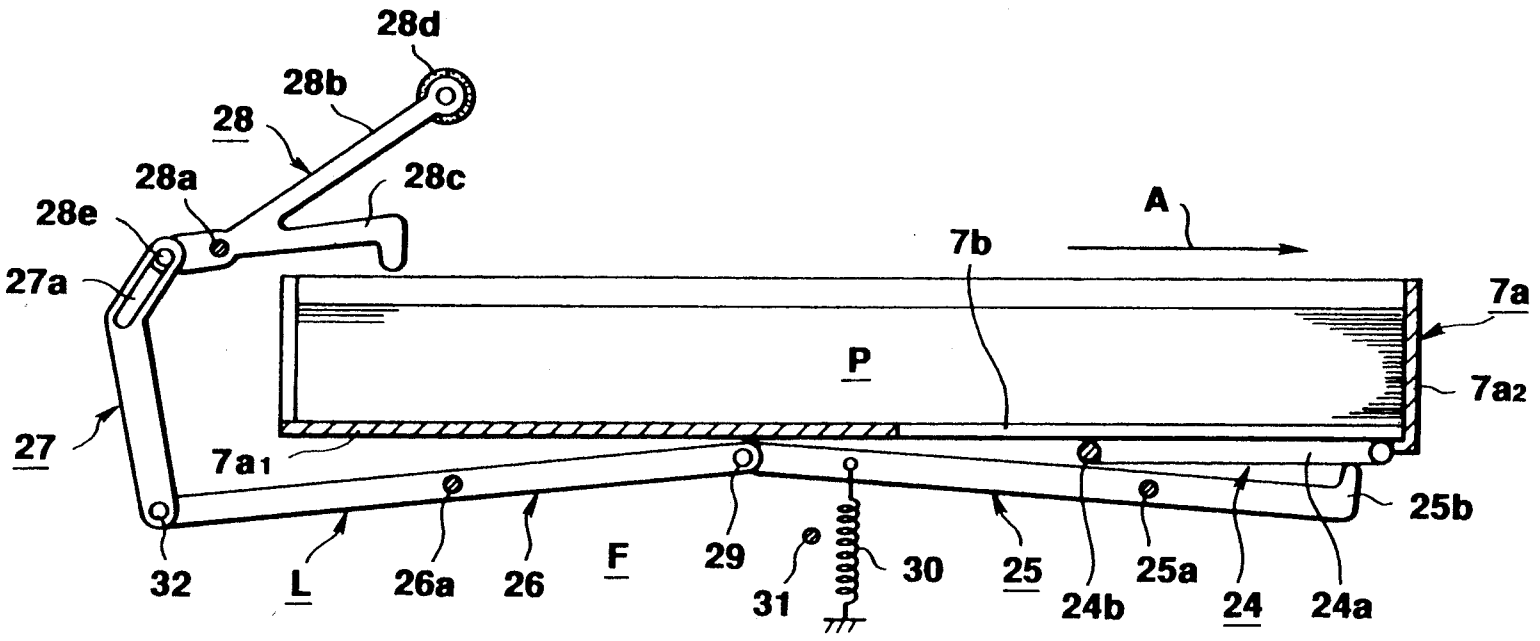
FIG. 8 is a cross-sectional view showing an ink roll type mark coating member and its associated link mechanism as applied to the plain paper FAX.

Lowering the push-up lever 24 to a position, as shown in FIG. 8, against a spring's urging force and latching it causes the first link bar 25 which contacts with the push-up lever 24 to be rotated clockwise against a rotation urging force of the tension spring 30 and, at the same time, the second link bar 26 to be rotated counterclockwise. When this occurs, the third link bar 27 is pulled down, causing the mark coating member 28 and hence the ink roll 28*d* and support arm (branch) 28*c* to be held in a position upwardly retracted from the insertion spacing of the paper supply cassette.

Figure 9:
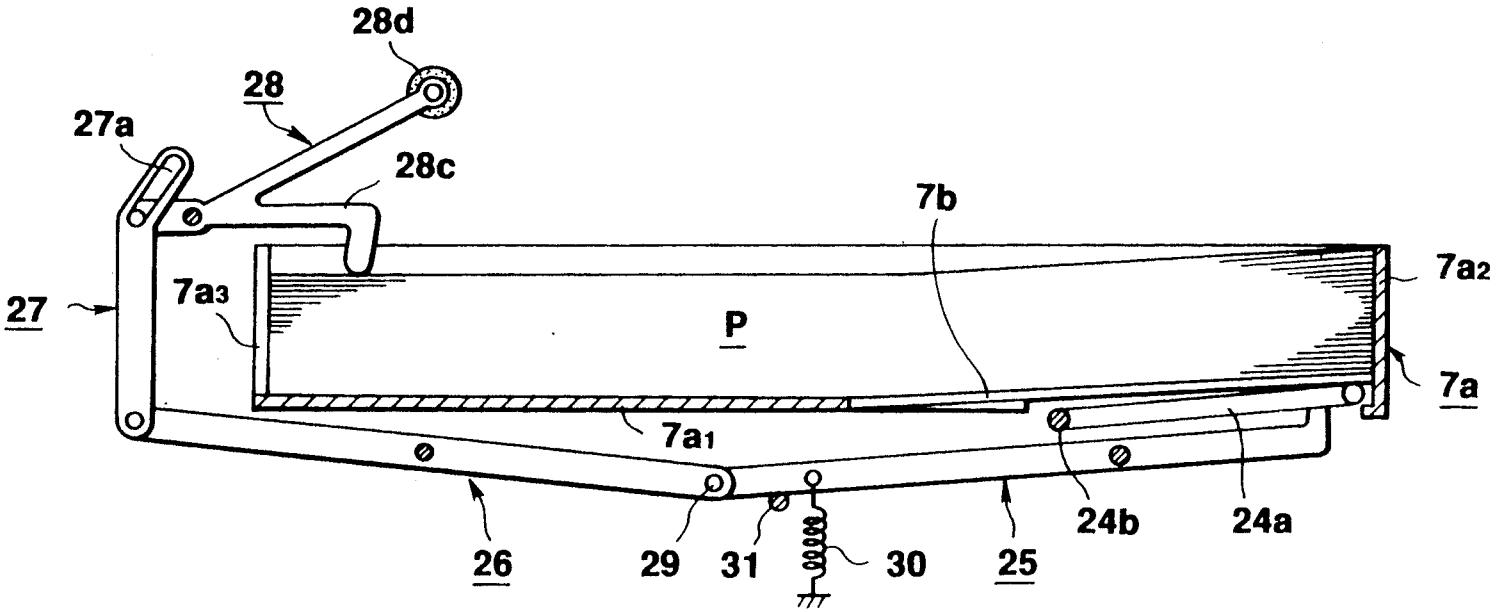
FIG. 9 is a cross-sectional view showing the associated operation of the mark coating member and paper stacking plate at a paper sheet supply start-up stage.
Figure 10:
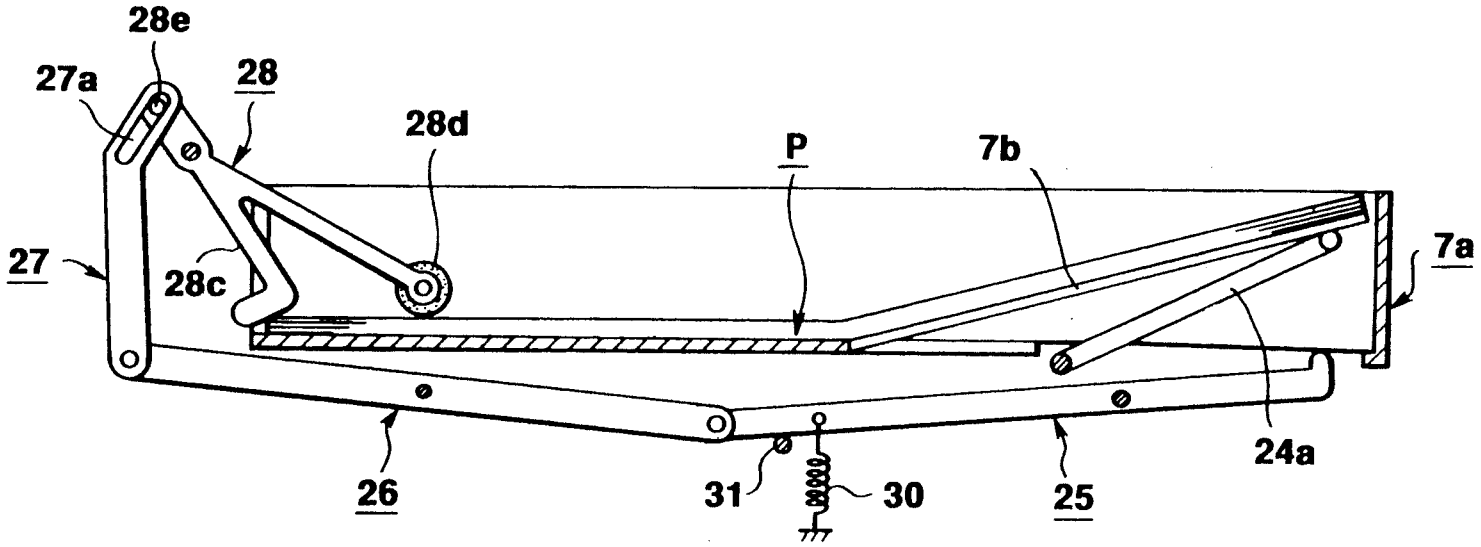
FIG. 10 is a cross-sectional view showing the associated operation of the mark coating member and paper stacking plate at an immediate stage of coating an "absence of paper" warning mark on paper.

In a direction perpendicular to this paper plane, the paper supply cassette 7 with a paper P stack placed thereon is loaded in an insertion spacing with the push-up lever 24*a* and mark coating member 28 placed in a retracted position. When the paper supply cassette has been loaded in place in the insertion spacing, an operation lever, not shown, is operated, a shaft 24*b* is rotated counterclockwise and the push-up lever 24 is counterclockwise rotated in an upward motion. By so doing, the paper stack plate 7*b* is rotated in an upward motion in the same direction. As shown in FIG. 9, the forward end portion of the paper P on a paper stack is lifted up until it is hooked by separation hooks or claws, not shown, provided at the forward corners of the cassette case 7*a*.

When, in FIG. 9, the push-up lever 24 is rotated in an upward motion, the first link bar 25 which contacts with the push-up lever 24 is rotated counterclockwise by a tension of the tension spring 30 until it contacts with a stopper pin 31. At the same time, the second link bar 26 is clockwise rotated, pushing up the third link bar 27. By so doing, a force for holding the mark coating member 28 in an upwardly retracted position as shown in FIG. 8 is released, allowing the mark coating member 28 to be rotated under its own weight so that the forward end of the support arm 28*c* is placed in contact with the rear end portion of the surface of top paper on the paper stack.

In the repetition of the reception printing, the height of the paper stack is decreased during which time the mark coating member whose support arm 28*c* contacts with the top paper is gradually rotated in the clockwise direction. At that time, the ink roll 28*d* of the mark coating member 28 does not contact with the top surface of the paper on the paper stack. Further, a clearance slit, not shown, is provided in the rear wall 7*a*₃ so as to prevent the mark coating member 28 from contacting with the rear wall 7*a*₃ of the cassette case. As a result, the mark coating member 28 is rotated under its own weight.

Figure 11:
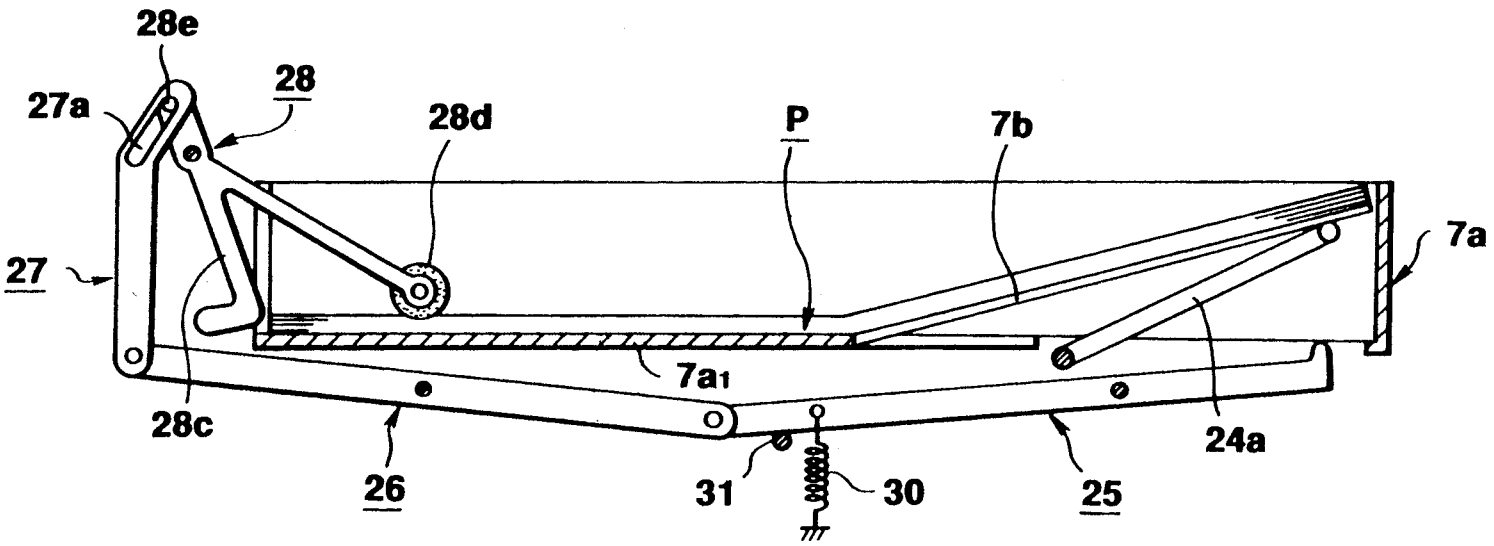
FIG. 11 is a cross-sectional view showing the associated operation of the mark coating member and paper stacking plate in an "absence of paper" warning mark coated state.

When the number of residual paper on the paper stack is, for example, about 30, the forward end of the support arm 28*c* is displaced out of the top surface of the paper stack. The mark coating member 28 is rotated clockwise until the ink roll 28*d* contacts with the top surface of the paper stack as shown in FIG. 11. Upon the supply of the paper with the ink roll 28*d* contacting with the top paper sheet on the paper stack, the ink roll 28*d* is rotated to allow an "absence of paper" warning colored ink mark to be clearly coated on the top paper sheet at a predetermined position. In this way, the "absence of paper" warning mark can positively be coated on the remaining paper sheet in a continuous way until no paper sheet is left on the paper supply cassette. In actual practice, however, a new supply of paper is replenished by the operator/user before no paper sheet is left on the paper supply cassette.

According to the present invention, the "absence of paper" warning mark is coated on the remaining paper sheet only when the amount of paper is reduced below a given level and a new supply of paper, upon being replenished, is correctly positioned in the paper supply cassette in which case a no "absence of paper" warning mark is not deposited on the new supply of paper.

According to the present invention, the marking means for performing a double function of detecting a residual amount of paper and coating an "absence of paper" warning mark on the paper can be simply provided by the mark coating member 28 comprised of the support arm 28*c* as the paper detection member and ink roll 28*d* as the mark applying member. Thus a simpler and low-cost image forming apparatus can be provided which can properly apply an "absence of paper" warning mark on the remaining paper of a paper stack below a given height level. The present mark coating member 28 can also be applied to the case where a paper conveying pattern is such that paper sheets are discharged with the upper surface of a paper stack emerging as an image formation surface and the image formation surface up.

The "absence of paper" warning mark applying ink can be used as in the preceding embodiment and any further explanation is, therefore, omitted.

A third embodiment of the present invention will be explained below.

In the third embodiment of the present invention, the operation of applying an "absence of paper" warning mark on the paper is done by the supplying/receiving of electric signals, not with the use of a mechanical link mechanism. As indicated by a dots-dash line in FIG. 1, a means is provided for detecting a residual amount of paper on a paper stack in the paper supply cassette as well as the presence or absence of paper there. This detecting means is provided as a paper detection sensor S above the cassette loading spacing. The paper detection sensor S is connected by a signal line means to a central controller C for controlling the operation of the plain paper FAX as a whole. A mark coater M is provided between the fixing unit 13 and the rear end portion of the paper supply cassette 7 and employed as a marking means for applying an "absence of paper" warning mark to the paper in the paper supply cassette 7. The mark coater M is connected by a signal line means to the central controller C. Upon receipt of a detection signal from the paper detection sensor S showing that a remaining amount of paper is decreased below a given level, the central controller C operates the mark coater M to enable an "absence of paper" warning mark to be applied to the supplying/conveying paper. In the present embodiment, the paper supply cassette 7 is unloaded out of the machine in a direction of A in FIG. 1.

Figure 12:
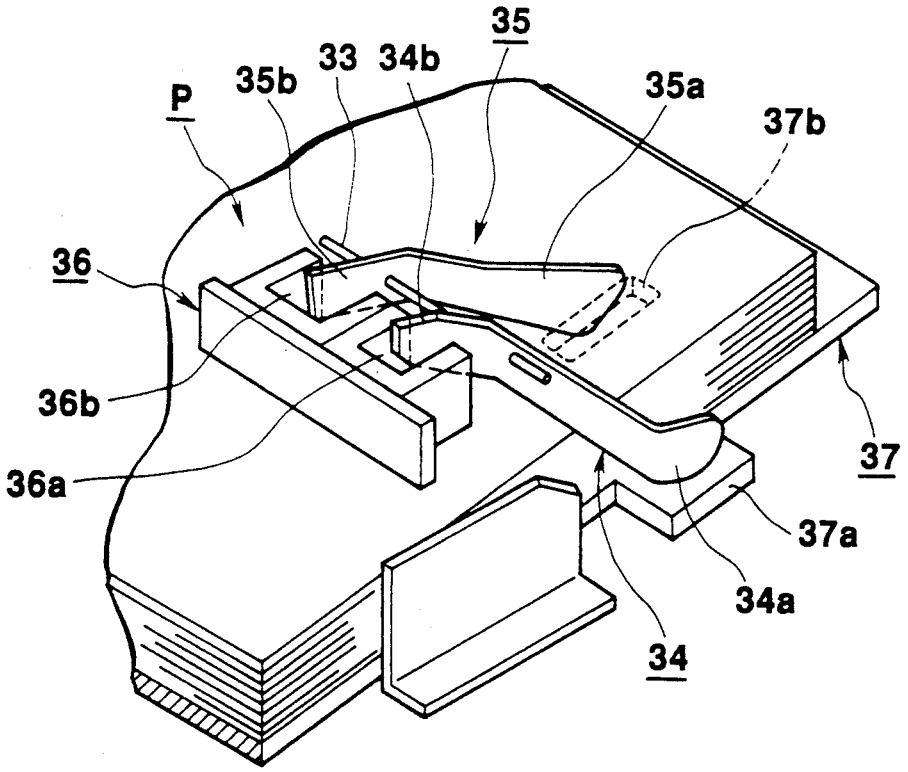
FIG. 12 is a perspective view showing a paper detection sensor as applied to the plain paper FAX.

FIG. 12 is a perspective view showing the paper detection sensor. As shown in FIG. 12, a pair of actuators 34, 35 are rotatably mounted on a shaft 33 fixed to the machine. A light-shutting type photosensor 36 is fixed to the machine and has a pair of detection grooves 36*a*, 36*b* corresponding to the pair of actuators 34, 35. The photosensor 36 includes switches SW1 and SW2 connected to the detection grooves 36*a* and 36*b*. The respective actuators 34 and 35 have "detecting" ends 34*a* and 35*a* of round corners and "detected" end portions 34*b* and 35*b*. The "detected" end portions 34*b* and 35*b* are moved into and out of the detection grooves 36*a* and 36*b* to turn the SW1 and SW2 ON and OFF.

A detection projection 37*a* is provided on the paper stacking plate 37. The detecting end 34*a* of the actuator 34 for turning SW1 ON and OFF contacts with the detection projection 37*a*. A detection slit 37*b* is provided in the paper stacking plate 37 and the detecting end 35*a* of the actuator 35 for turning SW2 ON and OFF is moved into and out of the detection slit 37*b*.

The paper detection sensor S as set out above can detect a residual amount of paper and presence/absence of paper as well as the presence/absence of the paper supply cassette, as tabulated below:

TABLE 1

| State of cassette & paper | | | SW1 | SW2 |
|---|---|---|---|---|
| Cassette loaded | Presence paper | high level | ON | OFF |
| | | low level | OFF | OFF |
| | absence of paper | | OFF | ON |
| cassette not loaded | | | ON | ON |

As shown in Table 1, with the paper supply cassette not loaded, both the actuators 34 and 35 are free and set substantially upright under their own weights and the "detected" end portions 34*b* and 35*b* are retracted out of the associated detection grooves 36*a* and 36*b* in the photosensor 36. In this case, both the switches SW1 and SW2 are both turned ON, informing the central controller that the paper supply cassette is not loaded.

Upon the loading of the paper supply cassette with a high stack (level) of paper placed thereon, the "detecting" end 34*a* of the actuator 34 contacts with the detection projection 37*a* of the paper stacking plate 37. At this time, the paper stacking plate 37 is somewhat rotated in upward motion (see FIG. 9) due to the high stack of paper present and the actuator 34 is only somewhat rotated counterclockwise. As a result, the "detected" end portion 34*b* of the actuator 34 is not moved into the detection groove 36*a* and the switch SW remains on. At this time, the other actuator 35 has its "detecting" end portion 35*a* contacting with the upper surface of the stacking paper and is rotated counterclockwise through an appreciable angle. Thus the "detected" end portion 35*b* of the actuator is moved into the detection groove 36*b*, shutting off an optical path and turning the switch SW2 OFF. With SW1 and SW2 ON and OFF, respectively, the corresponding detection signals are sent to the central controller C, informing that the paper supply cassette is loaded into the machine with a high stack (level]of paper P placed thereon.

With a repetitive use of paper P for receiving print, the paper P stack (level) is gradually decreased and the paper stacking plate 37 is rotated in up motion. When a residual amount of paper P is decreased to about 30 in number and the paper stacking plate 37 is rotated in up motion as shown in FIG. 11, the actuator 34 contacting with the paper stacking plate 37 is also counterclockwise rotated only through an appreciable angle and the "detected" end portion 34*b* of the actuator 34 is moved into the detection groove 36*a*, causing SW1 to be turned OFF. Even when the paper P is decreased in number, the paper level is substantially constant, the other actuator 35 involves no attitude variation and the switch SW2 remains ON. Thus the switches SW1 and SW2 are turned OFF and the corresponding detection signals E0N0287 are sent to the central controller C, indicating that the paper is used up.

Figure 13:
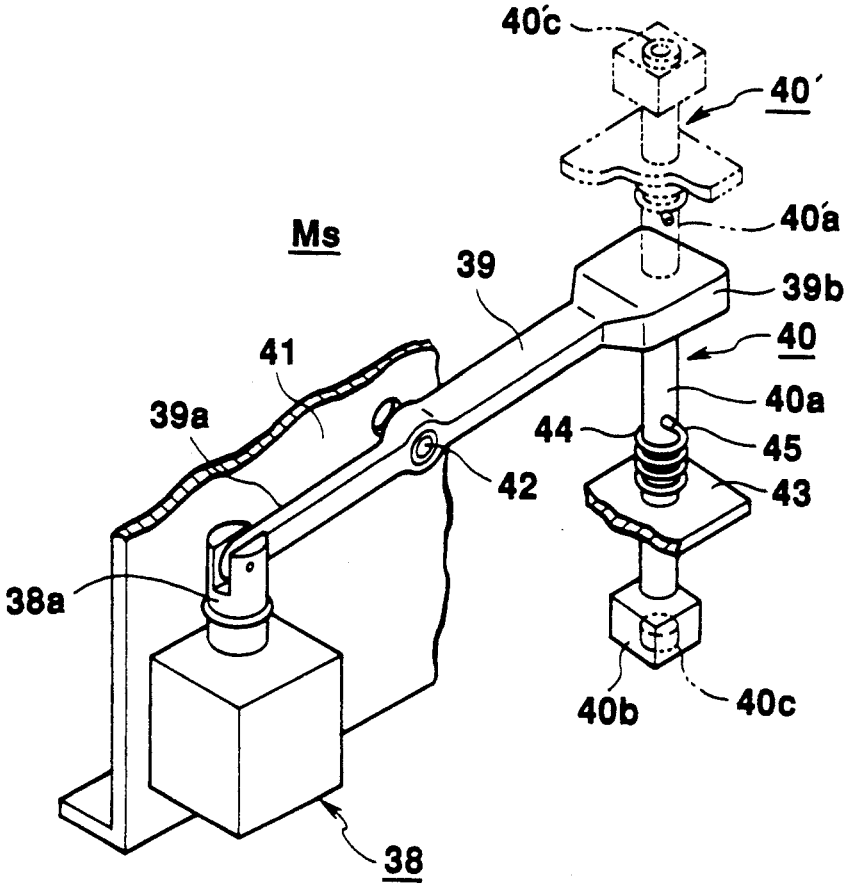
FIG. 13 is a perspective view showing a solenoid type stamper as one form of a mark coater as applied to the plain paper FAX.

FIG. 13 is a perspective view showing a solenoid type stamper Ms as one example of a mark coater M. The stamper Ms of the present embodiment comprises, in general, a push-pull solenoid 38, an operation transmission lever 39 and a stamp member 40. A shaft 42 mounted in a machine frame 41 extends through the middle section of the lever 39 so that the lever 39 is rotatably supported. One end portion 39*f* lever 39 is rotatably connected to a plunger 38*a* in the push-pull solenoid 38. The push-pull solenoid 38 is fixed to the machine frame 41. The other end portion 39*b* of the lever 39 is broadened to provide a striking member 39*b* of the lever 39.

The stamp member 40 comprises a slide shaft 40*a* so supported that it is vertically slidable in a support frame 43 fixed to the machine, an ink pot 40*b* mounted on the lower end of the slidable shaft 40*a* and an ink applying section 40*c* made of, for example, a porous rubber material or sponge. A coil spring 44 is wrapped around the slidable shaft 40*a*. The coil spring 44 is anchored between the support frame 43 and a set pin 45 provided erect on the slide shaft 40*a* so that the stamp member 40, once being lowered, is returned back to its initial position.

As ink for use for the stamper Ms of the present embodiment, use can properly be made of slow-drying color disappearing ink as in the aforementioned ink roll system. The so-called cold set type color disappearing ink can properly be employed in accordance with the present invention. By the cold set type ink is meant ink which employs, for example, paraffin wax solidified at ordinary temperature, not ink using an ordinary liquid as a solvent. It is, therefore, necessary that, upon coating, the ink be heated, and melted, to about 80° to 100° C. The stamper Ms of the present invention is so located in the vicinity of the fixing unit 13 equipped with the heating roll 13*b* that the ink pot 40*b* is heated to 80° to 100° C. through the utilization of the ambient heat of the heating roll 13*b* which is heated to 180° C.

The following is one example of cold set type color disappearing ink.

Using three components of coloring matter for the color disappearing ink, that is, compound (α): crystal violet lactone
compound (β): tertiarybutylcatechol
compound (γ): stearyle alcohol, a blend is made at a ratio of 1:2:10 and heated to 80° C. and melted to obtain coloring matter b. 10 parts by weight of the coloring matter b and 90 parts by weight of paraffin wax are melted, while being heated to 80° C., to obtain cold set type color disappearing ink. As wax for use as a solvent, use can be made of, for example, carnauba wax and microcrystalline wax.

The cold set type color disappearing ink thus obtained is filled in the ink pot 40*b* in the stamper shown in FIG. 13. Since the ink pot interior is heated to about 100° C. under the ambient temperature of the fixing unit, the ink is melted into droplets and oozes out of the ink applying section 40*c*.

When signals (SW1 and SW2 OFF) representing that a residual amount of paper is decreased below a given level is sent from the paper detection sensor S to the central controller C (see FIG. 1), an operation signal is delivered from the central control section C to the mark coater Ms. When this occurs, the push-pull solenoid 38 as shown in FIG. 13 is operated, causing the plunger 38*a* to be extended. The lever 39 is rotated clockwise, the striker 39*b* strikes the upper end of the slidable shaft 40*a*, and the slidable shaft 40*a* is lowered against the urging force of the coil spring 44. The forward end portion of the lowered slidable shaft 40*a* enters the paper supply cassette and has its ink applying section 40*c* brought into contact with the upper surface of the paper in a predetermined position on the paper stack. In this way, a blue "absence of paper" warning mark is printed on the paper.

The mark-attached paper, after being image-transferred and thermally fixed by the fixing unit, is discharged out of the machine with the paper placed in a face-down state and cooled. A clear blue "absence of paper" warning mark is displayed on the rear surface (upper surface) of the discharged paper. The ink is naturally cooled, set and stably affixed as a warning mark to the paper. Therefore, the operator can replenish a new supply of paper before the remaining paper sheets are all used up. The color of the applied ink disappears at the lapse of three days. Thus the "absence of paper" warning mark naturally disappears three days after it has been so printed on the paper, presenting a soil-less, clean printed copy for better preservation.

A similar stamp member 40' may be positioned above the lever 39 as indicated by dots-dash line in FIG. 13 and the slidable shaft is pushed up. In this case (see FIG. 1), the ink applying section 40*c'* is moved in a horizontal route of the sheet conveying path 14 downstream of the fixing unit 13 and enables the reverse surface of the paper which has been subjected to a fixing step to be printed with the warning mark. In this type of mark coater M, the paper which has been printed with the mark does not pass through the fixing unit and, hence, the solvent of the ink is difficult to evaporate, meaning that the aforementioned cold set type ink is more advantageous than the solvent evaporation type ink. Even in this embodiment, the three components of the coloring matter, that is, the compounds (α), (β) and (γ) can be blended in a proper ratio so as to set a period of time past which the marked color of the ink disappears.

Figure 14:
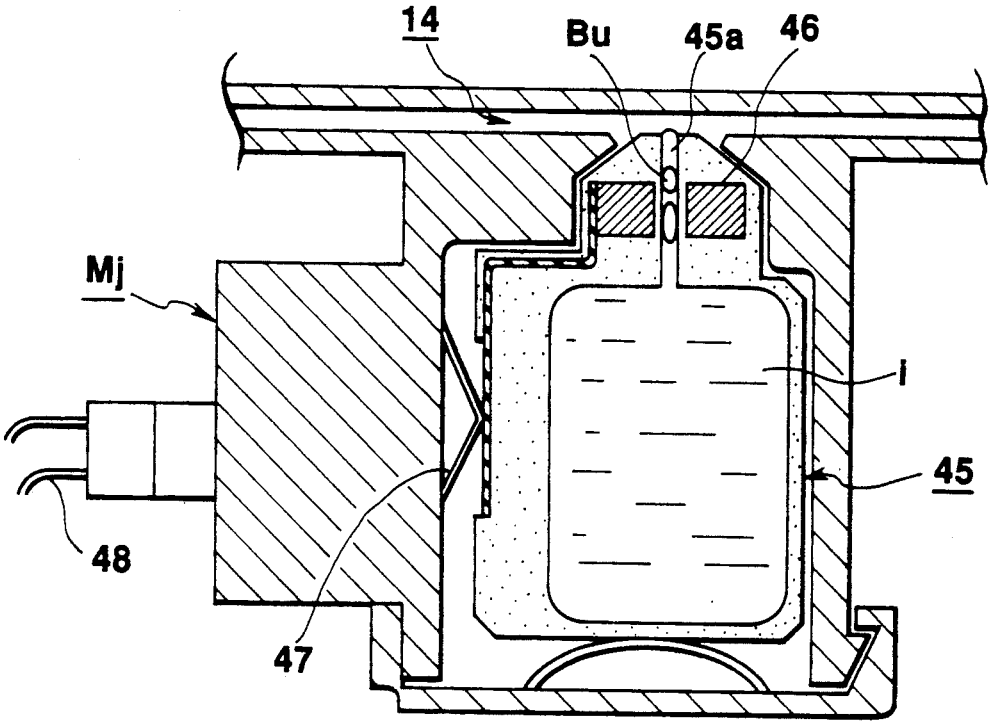
FIG. 14 is a cross-sectional view showing an ink jet type marker as one form of a mark coater as applied to the plain paper FAX.

Now an explanation will be given below of one example of a mark coater M suited to using quick-dry ink. FIG. 14 is a cross-sectional view showing a model of an ink jet type marker Mj. The quick-drying color disappearing ink i is filled in an ink bottle 45. A nozzle 45*a* extends from the ink bottle 45 and the forward end of the nozzle 45*a* faces the sheet conveying path 14 following the fixing path. Electric supply lines 48 are connected to a heater 46 through a leaf spring contact 47 for electricity supply.

Upon receipt of a signal for applying an "absence of paper" warning mark from the central controller, the contact 47 is closed, supplying power to the heater 46 via the electric supply line 48. By so doing, ink i in the nozzle 45*a* momentarily receives heat of 300° to 400° C. from the heater 46 and is evaporated instantly into a vapor phase. The ink i is jetted out of the forward end of the nozzle 45*a* due to a pressure upon evaporation, applying the "absence of paper" warning mark to the rear surface of the paper. In this connection it may be possible that the "absence of paper" warning mark is applied by the present ink jet type marker Mj to the paper on the paper supply cassette.

The quick-drying type color disappearing ink for use in the aforementioned ink jet type marker Mj may have the following compositions, for example.

| < a quick-drying color disappearing ink (1)> Using three components of a coloring matter, that is, |
|---|
| a compound (α): Rhodamine B lactam<br>a compound (β): α-naphthol<br>a compound (γ): butylstearate. |

a blend is made with a ratio of 1:1:5 and melted, while being heated to 80° C., to obtain a coloring matter C. 15% by weight of the coloring matter C, 50% by weight of a 20% acryl ethanol solution and 35% by weight of propanol are dissolved to produced quick-drying color disappearing ink (1). The quick-drying color disappearing ink (1), upon being applied by the aforementioned ink jet type marker Mj, gives a bright red "absence of paper" warning mark to the paper in which case the mark disappears with a passage of about two weeks.

| < a quick-drying color disappearing ink (2)> Using three components of a coloring matter, that is, |
|---|
| a compound (α): Rhodamine B lactam<br>a compound (β): P-oxy-propylbenzoate<br>a compound (γ): docosyl alcohol. |

a blend is made at a ratio of 1:2:10 and melted, while being heated to 80° C., to obtain a coloring matter c'. 15% by weight of the coloring matter c', 50% by weight of a 20% acrylethanol solution and 35% by weight of propanol are dissolved to yield quick-drying color disappearing ink (2). The quick-drying color disappearing ink (2), upon being applied by the aforementioned ink jet type marker Mj, gives a bright red "absence of paper" warning mark to the paper and the marked ink color disappears with a passage of about 10 days.

| < a quick drying color disappearing ink (3)> Using three components of a coloring matter, that is, |
|---|
| a compound (α): Rhodamine B lactam<br>a compound (β): P-oxy-methylbenzoate<br>a compound (γ): docosyl alcohol. |

a blend is made at a ratio of 1:2:10 and melted, while being heated to 80° C., to obtain a coloring matter d. 20% by weight of the coloring matter d, 70% by weight of a 10% ethylcellulose xylene solution and 10% by weight of n-butylacetate are dissolved to obtain quick-drying color disappearing ink (3). The quick drying color disappearing ink, upon being applied by the aforementioned ink jet type marker, gives a bright red "absence of paper" warning mark to the paper and the marked ink color disappears in four days.

| < a quick drying color disappearing ink (4)> Using three components of a coloring matter, that is, |
|---|
| a compound (α): crystalviolet lactone<br>a compound (β): octylphenol<br>a compound (γ): cetyl alcohol. |

a blend is made at a ratio of 1:2:10 and melted, while being heated to 80° C., to obtain a coloring matter e. The coloring matter e is likewise dissolved in an organic solvent and, upon being applied by the ink jet type marker Mj, gives a bright blue "absence of paper" warning mark to the paper and the marked ink color disappears in about one week.

As will be understood from the above, some quick-drying color disappearing ink, though cumbersome in handling, replenishing, etc., can be properly employed by using the ink jet type marker Mj as the mark coater M. As set out above, the quick-drying color disappearing ink is versatile in color and in color disappearance period and can be selected in accordance with the user's needs.

The present invention is not restricted to the aforementioned embodiments and various changes and modifications can be made without departing from the spirit and scope of the present invention.

As the ink for giving the "absence of paper" warning mark, use may be made of the ink containing the aforementioned three components as well as ink which undergoes a change from a colored to a colorless state through a change from an alkaline phase to an acidic phase upon evaporation of a solvent. If use is selectively made of clear color ink, such as yellow ink, which has a sensitivity to the photosensitive body, any "absence of paper" warning mark does not appear on the paper in those cases where a copy or copies have to be taken promptly with a received print as an original sheet.

The present invention is not restricted only to the plain paper FAX equipment, but is also applicable to a page printer, etc.

As set out in detail above, according to the present invention it is possible to provide a compact, low-cost image forming apparatus which can properly inform an operator/user of a decreased residual amount of cut paper in a simpler way by applying an "absence of paper" warning mark to the paper by means of a marking means provided separately from the imaging forming section when that residual amount of cut paper is decreased below a given height level and, by doing so, can prevent occurrence of the "absence of paper" state in advance. If, in this case, use is made, as the warning mark, of ink whose color disappears with a passage of time, the printed paper with an image formed thereon provides a document for better preservation with an unnecessary warning mark made invisible.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

paper stacking means for stacking a plurality of paper sheets cut to a given size;

paper supplying means for supplying the paper sheets, one by one, which are stacked on the paper stacking means;

an image forming section for enabling an image which corresponds to supplied image information to be formed on the paper sheet supplied from the paper supplying means;

discharging paper stacking means for stacking the paper sheet discharged out of the image forming apparatus after it has its image formed by the image forming section; and marking means, provided separate from the image forming section, for continuously applying an "absence of paper" warning mark to the paper sheet remaining in the paper stacking means, during a given period of time from a time at which a residual amount of paper sheets on the paper stacking means is lowered below a given level during the supply of paper sheets by the paper supplying means to a given time preceding a time at which the residual amount of paper sheets is all used up whereupon an image forming operation by the image forming section is to be stopped and for informing a user of a reduced residual amount of paper sheets over said given period of time.

2. The image forming apparatus according to claim 1, further comprising communication means for enabling the image information to be transmitted from an outer source to the image forming section.

3. The image forming apparatus according to claim 1, wherein said marking means applies the "absence of paper" warning mark to a reverse surface as opposed to that paper sheet surface on which the image is formed by the image forming section.

4. The image forming apparatus according to claim 1, wherein said marking means applies the "absence of paper" warning mark to that paper sheet surface on which the image is formed by the image forming section.

5. The image forming apparatus according to claim 1, wherein said marking means applies the "absence of paper" warning mark to the paper sheet with the use of ink.

6. The image forming apparatus according to claim 5, wherein the color of said ink disappears with the passage of a given period of time after the paper sheet is discharged onto the discharging paper stacking means.

7. The image forming apparatus according to claim 1, wherein said marking means includes a contacting member for contacting with an edge face of the paper sheet over a given length range in a direction in which the paper sheets are stacked on the paper stacking means, the contacting member contacting with the edge face of the paper sheet to apply the "absence of paper" warning mark there.

8. The image forming apparatus according to claim 7, wherein said contacting member includes an ink coating member with ink impregnated therein.

9. The image forming apparatus according to claim 8, further comprising means for heating and drying the paper sheet during a period of time from the application of the "absence of paper" warning mark to the paper sheet by the ink coating member to the stacking of the marked paper sheet on the discharging paper stacking means, and said ink is substantially slow drying at ordinary temperature and is of such a type that its color disappears in a predetermined time period after the marked paper sheet is stacked on the discharging paper staking means.

10. The image forming apparatus according to claim 1, wherein said marking means comprises a moving mechanism contacting with the paper sheet on the paper stacking means and moving in interlock with a lowering in the number of paper sheets and a mark imparting member, provided in the moving mechanism, for imparting the "absence of paper" warning mark to the paper sheet by being brought into contact with the upper surface of the paper sheet at a point of time at which a residual amount of paper sheets on the paper stacking means reaches a predetermined height level.

11. The image forming apparatus according to claim 10, wherein said mark imparting member includes an ink coating member impregnated with ink.

12. The image forming apparatus according to claim 11, further comprising means for heating and drying the paper sheet for an interval from the imparting of the "absence of paper" warning mark to the paper sheet by the ink coating member to the stacking of the paper sheet on the discharging paper stacking means and the ink is substantially sow drying at ordinary temperature and is of such a type that the color of the ink disappears in a predetermined time period after the marked paper sheet is stacked on the discharging paper stacking means.

13. The image forming apparatus according to claim 1, further comprising means for detecting that a residual amount of paper sheet on the paper stacking means reaches a predetermined height level and said marking means includes means for imparting the "absence of paper" warning mark to the residual paper sheets on the basis of the result of that detection by the detecting means.

14. The image forming apparatus according to claim 13, wherein said marking means includes means for imparting the "absence of paper" warning mark to the residual paper sheets with the use of ink.

15. The image forming apparatus according to claim 14. further comprising means for heating and drying the paper sheet for an interval from the imparting of the "absence of paper" warning mark to the paper sheet by the ink imparting means to the stacking of the paper sheet on the discharging paper stacking means and the ink is substantially slow drying at ordinary temperature and is of such a type color of the ink disappears in a predetermined time period after the marked paper sheet is stacked on the discharging paper stacking means.

16. The image forming apparatus according to claim 14. wherein said ink is substantially quick drying ordinary temperature and is of such a type that it is quickly dried up after the imparting of the "absence of paper" warning mark to the paper sheet by the ink imparting means and that the color of the ink disappears in a predetermined time period after the marked paper sheet is stacked on the discharging paper stacking means.

* * * * *